US010059492B2

(12) United States Patent
Hawry et al.

(10) Patent No.: US 10,059,492 B2
(45) Date of Patent: Aug. 28, 2018

(54) DISPENSING CONTAINER PACKAGE

(71) Applicant: Berlin Packaging, LLC, Chicago, IL (US)

(72) Inventors: Liam Hawry, Chicago, IL (US); James Tobin, Marina Del Rey, CA (US); Brett Niggel, Chicago, IL (US)

(73) Assignee: Berlin Packaging, LLC, Chicago, IL (US)

( * ) Notice: Subject to any disclaimer, the term of this patent is extended or adjusted under 35 U.S.C. 154(b) by 0 days.

(21) Appl. No.: 15/379,580

(22) Filed: Dec. 15, 2016

(65) Prior Publication Data

US 2018/0170631 A1 Jun. 21, 2018

(51) Int. Cl.

| | |
|---|---|
| ***B67D 1/16*** | (2006.01) |
| ***B65D 47/00*** | (2006.01) |
| ***B67D 3/00*** | (2006.01) |
| ***B65D 47/12*** | (2006.01) |
| ***B65D 25/42*** | (2006.01) |
| ***B65D 1/02*** | (2006.01) |
| ***B65D 43/02*** | (2006.01) |
| ***B65D 51/24*** | (2006.01) |
| *B67C 11/00* | (2006.01) |

(52) U.S. Cl.

CPC ..... *B65D 47/127* (2013.01); *B65D 1/023* (2013.01); *B65D 25/42* (2013.01); *B65D 43/0212* (2013.01); *B65D 51/245* (2013.01); *B67C 11/00* (2013.01)

(58) Field of Classification Search

CPC ..... B65D 47/127; B65D 1/023; B65D 25/42

USPC ..... 222/546, 556, 557, 562, 570; 206/219, 206/221, 557; 220/212, 568, 711, 713, 220/714; 215/DIG. 8

See application file for complete search history.

(56) References Cited

U.S. PATENT DOCUMENTS

| | | | | | |
|---|---|---|---|---|---|
| 4,128,189 | A * | 12/1978 | Baxter | B65D 47/12 | 222/109 |
| 5,060,827 | A * | 10/1991 | Segati | B65D 41/26 | 141/381 |
| 5,582,329 | A * | 12/1996 | Watson | B65D 47/068 | 222/108 |
| 6,964,359 | B1 * | 11/2005 | Darr | B65D 47/06 | 222/570 |
| 7,070,046 | B2 * | 7/2006 | Cho | B65D 51/2842 | 206/219 |

(Continued)

*Primary Examiner* — Vishal Pancholi
(74) *Attorney, Agent, or Firm* — Adam K. Sacharoff; Much Shelist, PC

(57) ABSTRACT

In one embodiment there is provided a container package configured to hold a substance. The container package includes a main container configured to hold a substance, either liquid or solid; a spout adapter configured to secure to the main container, the spout adapter having a spout end configured for pouring a substance out of the main container; a funnel adapter configured to frictionally fit onto the spout adapter, the funnel adapter having a funnel end configured to fit over the spout end; and an overcap configured to fit over the funnel adapter and removably secured to the spout adapter. When the overcap is removed the substance can be poured into the overcap and wherein the funnel adapter is configured for removable from the spout adapter and fitted into the overcap such that the substance in the overcap is pourable through the funnel adapter.

15 Claims, 11 Drawing Sheets

(56) References Cited

U.S. PATENT DOCUMENTS

| | | | | |
|---|---|---|---|---|
| 7,959,034 | B2 * | 6/2011 | Faaborg | B65D 41/0471 222/109 |
| 8,118,066 | B2 * | 2/2012 | Mehlhausen | B65D 47/06 141/18 |
| 8,322,573 | B2 * | 12/2012 | Tauber | B65D 47/122 222/111 |
| 2004/0050884 | A1 * | 3/2004 | Boggs | B65D 47/127 222/520 |
| 2007/0062906 | A1 * | 3/2007 | Morano | B65D 47/06 215/311 |
| 2008/0017675 | A1 * | 1/2008 | Pressey | B65D 41/26 222/481.5 |
| 2011/0113972 | A1 * | 5/2011 | Tatera | B01F 3/04801 99/323.1 |
| 2011/0204099 | A1 * | 8/2011 | Piscopo | B65D 1/023 222/111 |

* cited by examiner

DISPENSING CONTAINER PACKAGE

FIELD OF THE INVENTION

The present invention relates to a container configured to hold a substance, and particularly to an overcap fitted onto the container and configured for use as a measuring cup and dispenser for pouring contents into a bottle.

BACKGROUND OF THE INVENTION

Containers which hold a substance, be it liquid or solid, are used in the food and drink industry. Often times the containers have a wide mouth and include a scoop, that allows a user to remove the substance and add it to a drink or food. The present embodiments provide for a unique container package for accomplishing this objective.

SUMMARY OF THE INVENTION

In one embodiment of the present invention there is provided a container package configured to hold a substance. The container package includes a main container configured to hold a substance, either liquid or solid; a spout adapter configured to secure to the main container, the spout adapter having a spout end configured for pouring a substance out of the main container; a funnel adapter configured to frictionally fit onto the spout adapter, the funnel adapter having a funnel end configured to fit over the spout end; and an overcap configured to fit over the funnel adapter and removably secured to the spout adapter, wherein when the overcap is removed the substance can be poured into the overcap and wherein the funnel adapter is configured for removable form the spout adapter and fit into the overcap such that the substance in the overcap is pourable through the funnel adapter.

In other aspects the container package includes a container having an annular opening created by an annular rim that terminates to an outside edge, a container neck depending from the outside edge and the neck having an outer surface, and further having a plurality of locking ramps and a plurality of channel ramps interspaced between adjacent locking ramps, along the outer surface of the neck. The spout adapter includes a plurality of knobs extending internally from an inside portion of a side wall defined from the spout adapter, and wherein the knobs are positioned and configured to correspond and engage the locking ramps and channel ramps on the container, such that when engaged, the knobs corresponding to the locking ramps slide and click lock with the surface detents maintaining the spout adapter in place with the container.

In another embodiment the container package includes the spout adapter being further configured to include a base having the spout end emanating therefrom. The base further having a downwardly extending side wall, and a plurality of spout channel ramps configured around an outside portion of the side wall. Each spout channel ramp includes an entrance, a stop edge, and an upper edge with a downward flange extending therefrom. The overcap is then configured to fit over the funnel adapter and spout adapter. The overcap includes flanges positioned around an inside portion of the overcap. The flanges being configured and positioned to engage the spout channel ramps on the outside of the side wall of the spout, and wherein the overcap includes a surrounding side wall that includes at its lower end the inside portion of the overcap and further includes an indentation configured to engage a lower edge of the funnel adapter when the funnel adapter is removed from the spout adapter and secured to the overcap.

In another aspect of the invention the overcap may includes a top surface that rests over a funnel end and spout end, such that when secured onto the spout adapter the substance in the container does not leak. Alternatively or together therewith the overcap includes a surrounding side wall that includes at its lower end the inside portion of the overcap and includes measuring lines at various intervals.

Yet in still other aspects, the plurality of locking ramps are evenly spaced around the neck at 180 degree intervals and the plurality of channel ramps are interspaced between adjacent locking ramps at even intervals. Each locking ramp may further an entrance opening into a channel, which ends at a surface detent.

The container package may also include fins on an inside surface, the fins configured to allow a smooth flow when pouring a substance out of the container.

Numerous other advantages and features of the invention will become readily apparent from the following detailed description of the invention and the embodiments thereof, from the claims, and from the accompanying drawings.

BRIEF DESCRIPTION OF THE DRAWINGS

A fuller understanding of the foregoing may be had by reference to the accompanying drawings, wherein.

DETAILED DESCRIPTION OF THE DRAWINGS

Figure 1:
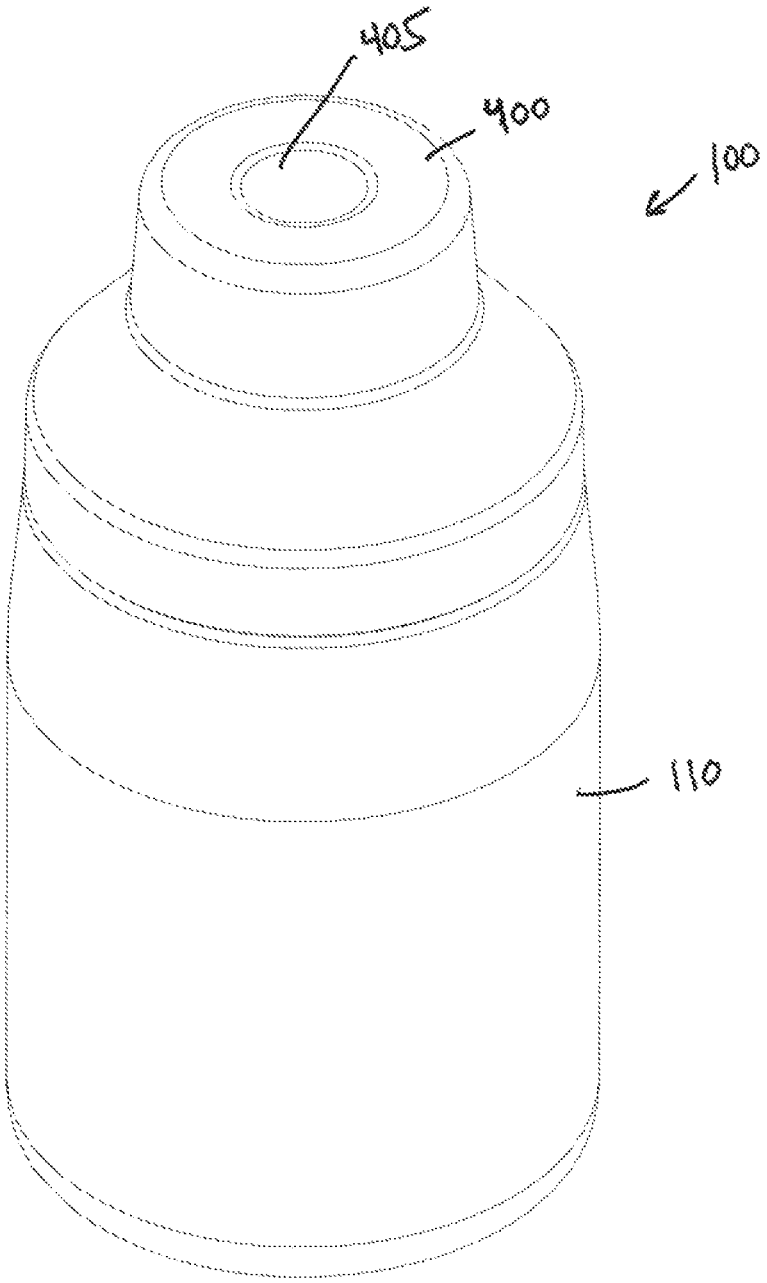
FIG. 1 is a perspective view of the assembled dispensing container package in accordance with an embodiment of the present invention.
Figure 2A:
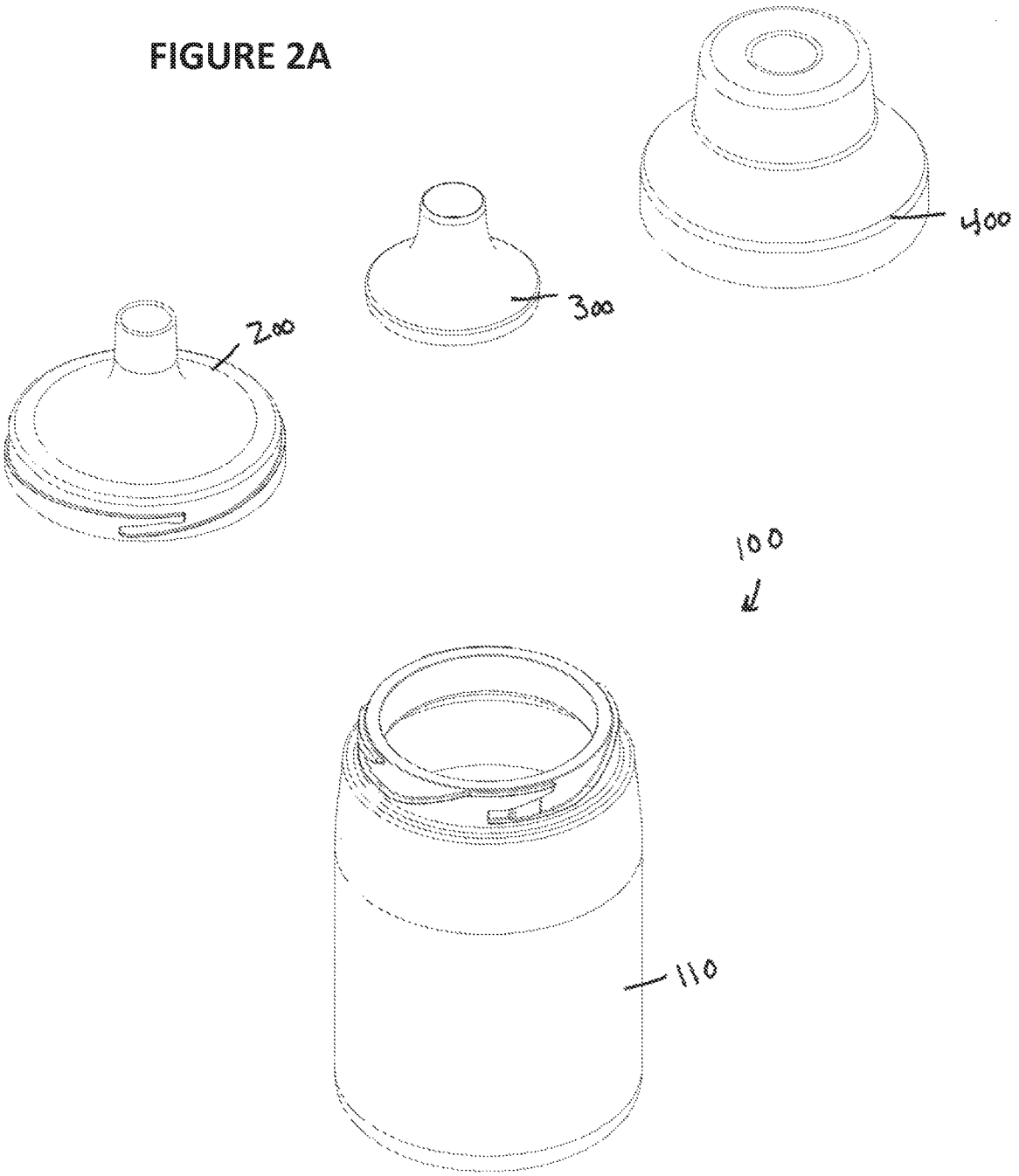
FIG. 2A is an exploded view of the dispensing container package in accordance with an embodiment of the present invention.
Figure 2B:
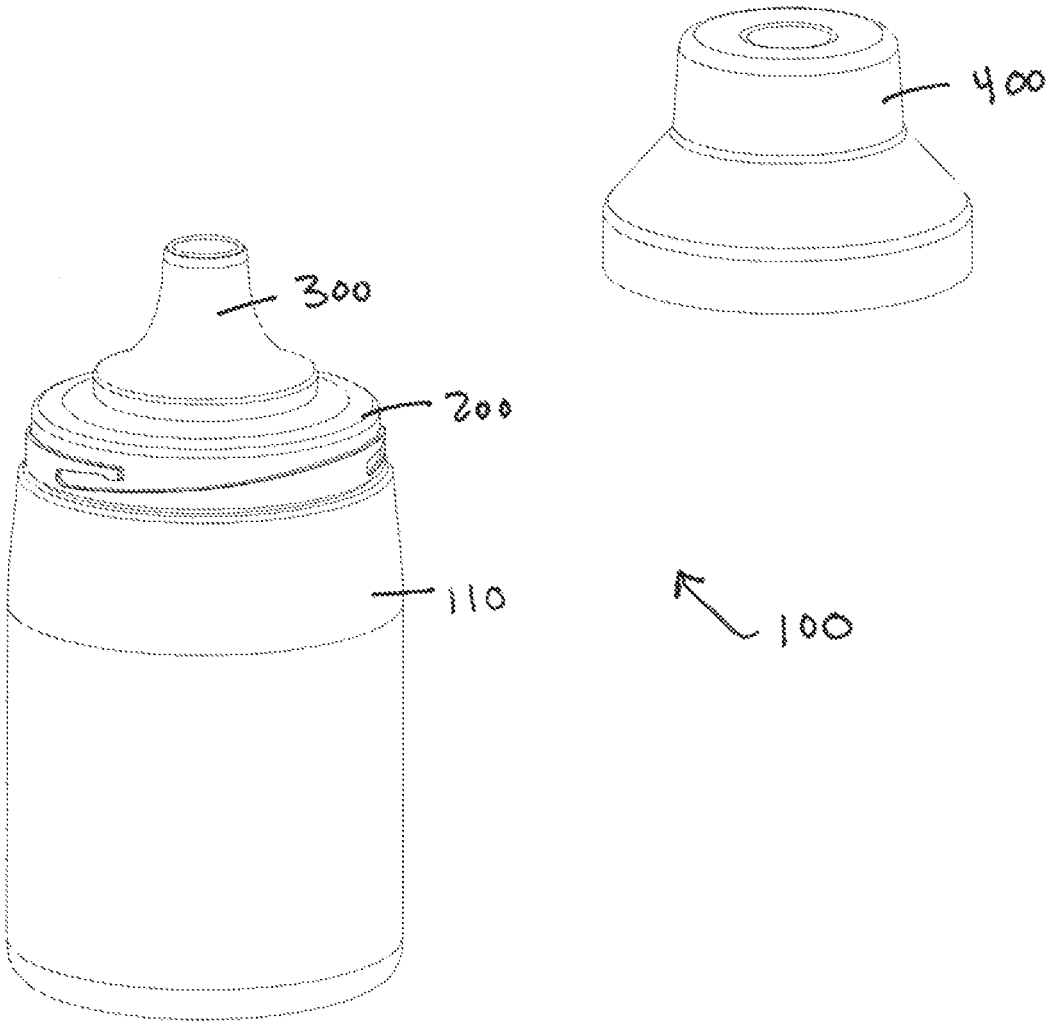
FIG. 2B is a partial exploded view of the dispensing container package in accordance with an embodiment of the present invention.
Figure 2C:
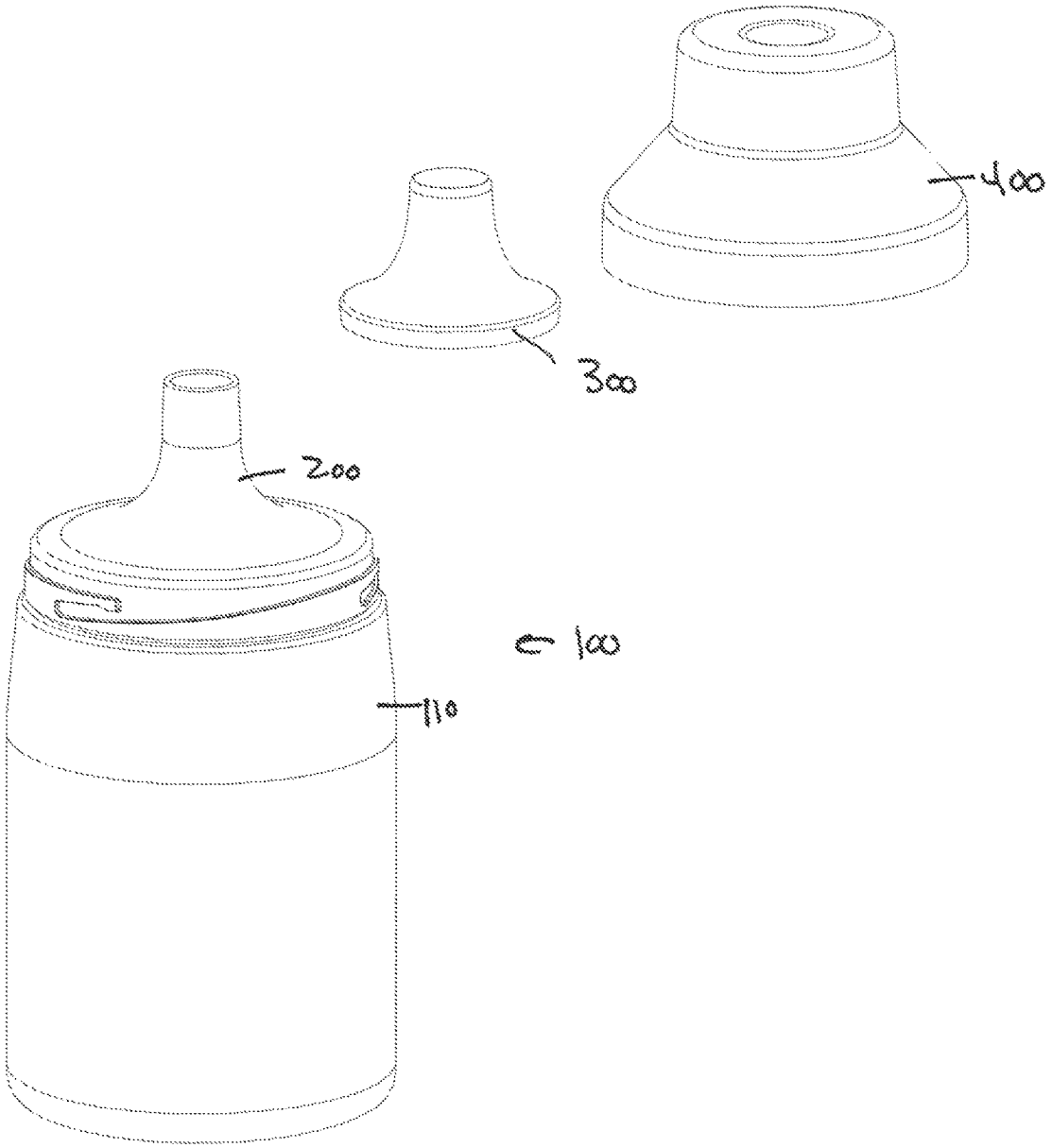
FIG. 2C is another partial exploded view of the dispensing container package in accordance with an embodiment of the present invention.

While the invention is susceptible to embodiments in many different forms, there are shown in the drawings and will be described in detail herein the preferred embodiments of the present invention. It should be understood, however, that the present disclosure is to be considered an exemplification of the principles of the invention and is not intended to limit the spirit or scope of the invention and/or claims of the embodiments illustrated.

Referring now to the figures, FIG. 1 through XYZ there is a shown a container package configured to hold a substance, either liquid or solid, and configured to allow a user to easily measure out the substance and add it to a bottle, such as a water bottle.

The container package 100 includes a main container 110 that holds a substance, either liquid or solid. Secured to the main container 110 is a spout adapter 200. A funnel adapter 300 fits over the spout adapter 200. Lastly, an overcap 400 is configured to secure over the components and lock onto the spout adapter 200.

Figure 3A:
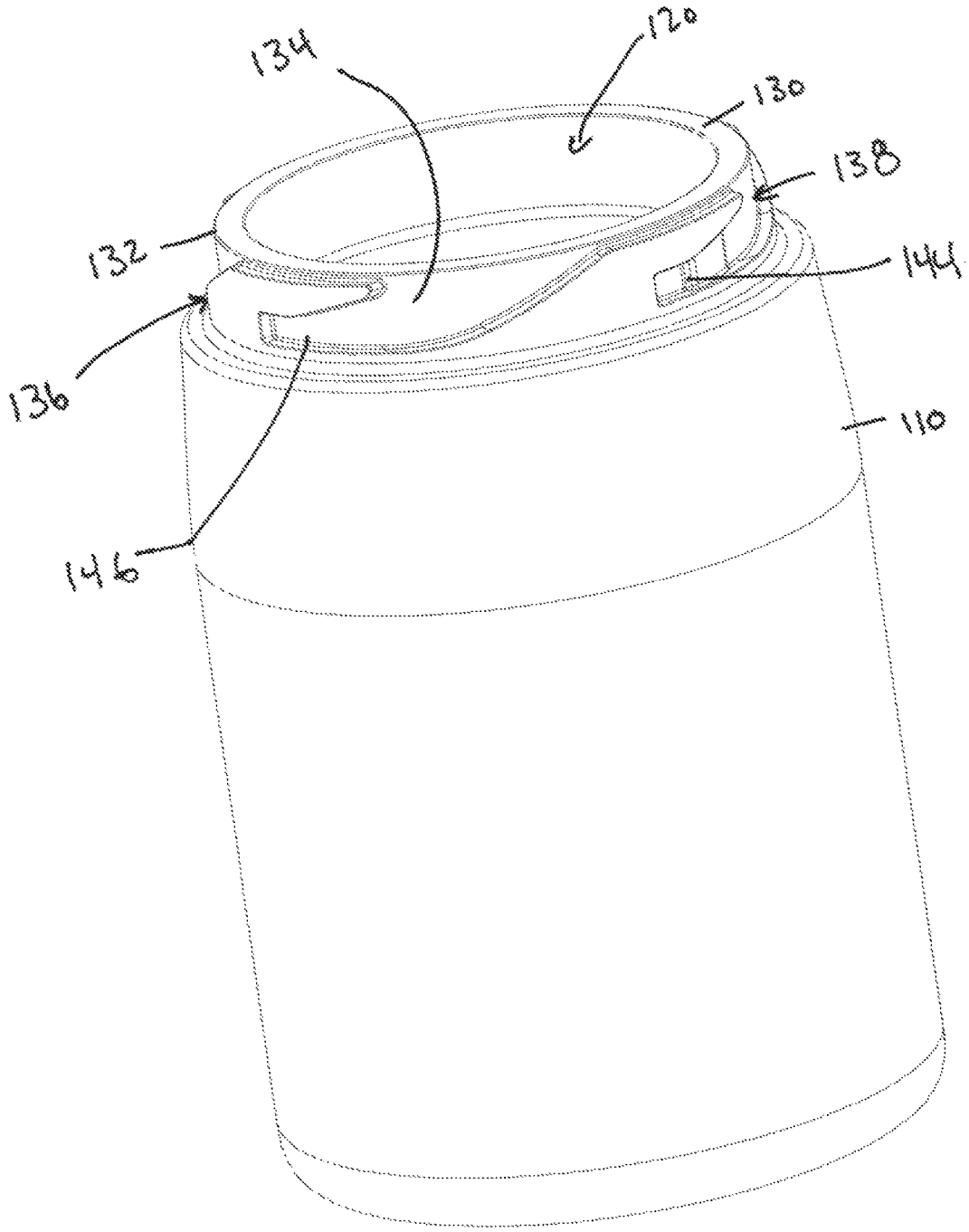
FIG. 3A is a perspective view of a container from the dispensing container package in accordance with an embodiment of the present invention.
Figure 3B:
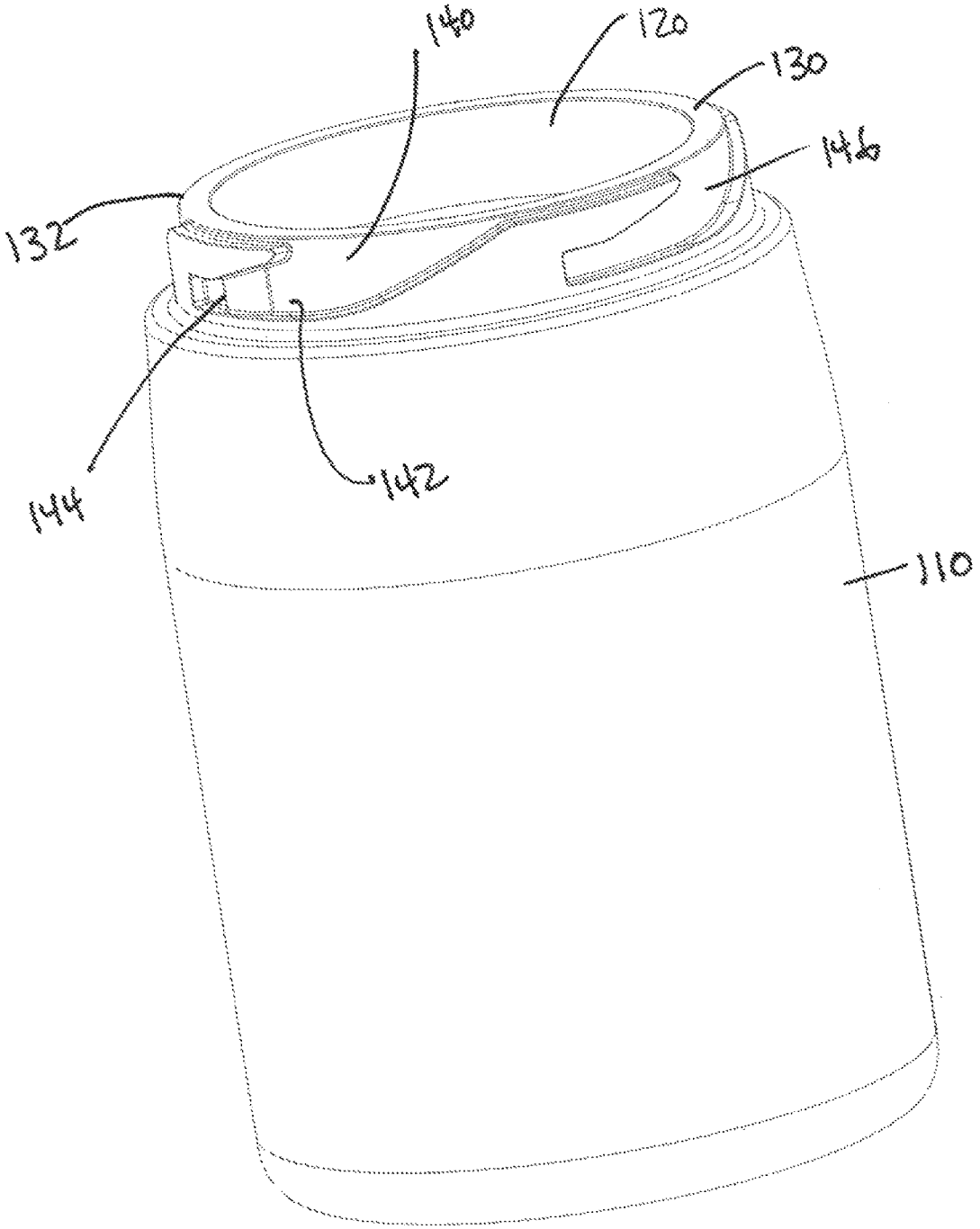
FIG. 3B is another perspective view of the container from the dispensing container package in accordance with an embodiment of the present invention.

As illustrated in FIGS. 3A and 3B, the container 110 includes an annular opening 120 into the container. The opening 120 is surrounded by a rim 130 that terminates at an outside edge 132 and which descends to an outer surface 134 of the container neck 136. The outer surface 134 of the neck 136 includes locking ramps 138 located around the neck 136. Preferably the locking ramps 138 are spaced evenly around the neck 136. As illustrated, the embodiment includes a pair of locking ramps 138 spaced 180 degrees apart from each other. The locking ramps 138 include an entrance 140 opened into a channel 142 that ends at a surface detent 144. In addition, spaced evenly around the neck 136 between adjacent locking ramps 138 are channel ramps 146. The channel ramps 146, as explained below, are provided to help align the spout 200 when it is secured to the container 110.

Figure 4A:
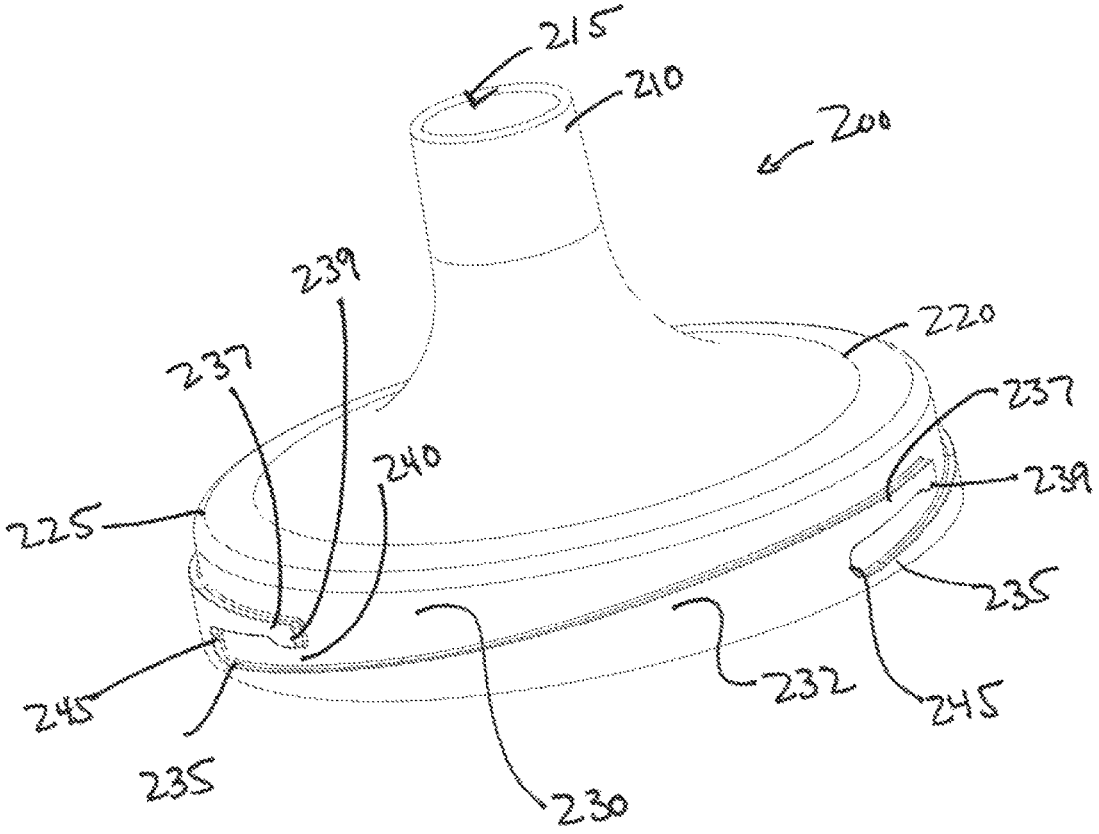
FIG. 4A is a perspective view of a spout adapter from the dispensing container package in accordance with an embodiment of the present invention.
Figure 4B:
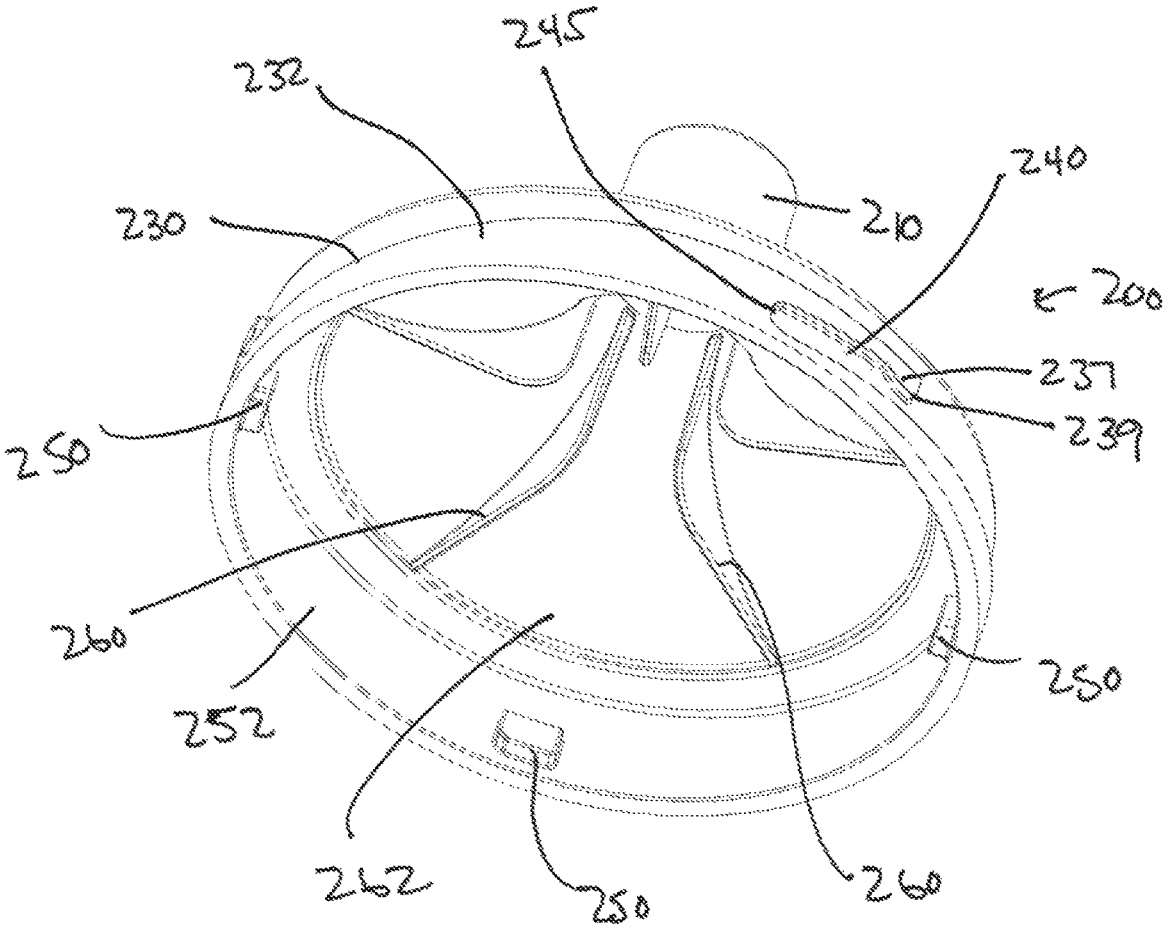
FIG. 4B is another perspective view of the spout adapter from the dispensing container package in accordance with an embodiment of the present invention.

As illustrated in FIGS. 4A and 4B, the spout adapter 200 is configured to include a spout end 210 emanating from a base 220. The spout end 210 includes an spout opening 215, which when the spout adapter 200 is secured to the container 110 permits the substances to be poured from the container 110. The base 220 terminates to an edge 225, that has a downward extending side wall 230. The outside 232 of the side wall 230 includes a plurality of spout channel ramps 235. The spout channel ramps 235 are evenly spaced around the outside 232 of the side wall 230, and preferably include four spaced at 90 degree intervals. Each of the spout channel ramps 235 includes an entrance 240 and a stop edge 245 at the end of the channel ramp. In additional, each of the spout channel ramps 235 includes an upper edge 237 with a downward flange 239, which as explained below helps to secure the funnel adapter 300 onto the spout adapter 200.

Internally, the spout adapter 200 includes a plurality of knobs 250 extending internally from the inside 252 of the side wall 230. The knobs 250 are positioned and configured to correspond and engage the locking ramps 138 and channel ramps 146 on the container 110. When engaged, the knobs 250 will slide into the channels and click lock with the surface detents 144 maintaining the spout adapter 200 in place with the container 110. However, the user with a twisting force can overcome the surface detents 144 to turn and remove the spout adapter 200. In addition, the spout adapter 200 includes fins 260 on the inside surface 262 of the base 220. The fins 260 assist in breaking up the substance, allowing for a smooth flow for pouring purposes, especially if the substance is a powder.

Figure 5:
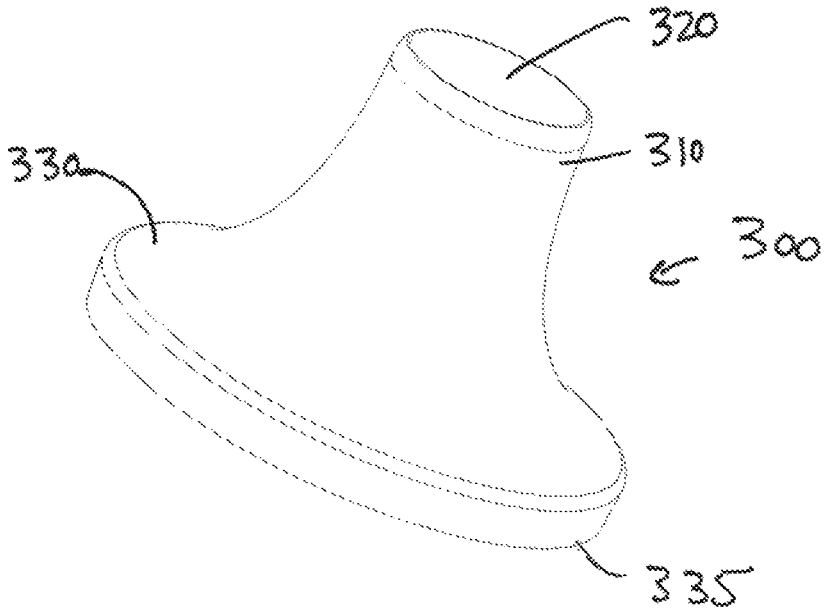
FIG. 5 is a perspective view of the funnel adapter from the dispensing container package in accordance with an embodiment of the present invention.

Illustrated in FIG. 5 is the funnel adapter 300. The funnel adapter 300 includes a funnel end 310 with a funnel opening 320, which when secured to the spout adapter 200 frictionally engages to the spout end 210 such that the funnel opening 320 aligns with the spout opening 215. The funnel adapter 300 includes a funnel base 330 that sits over a portion of the spout base 220.

Figure 6:
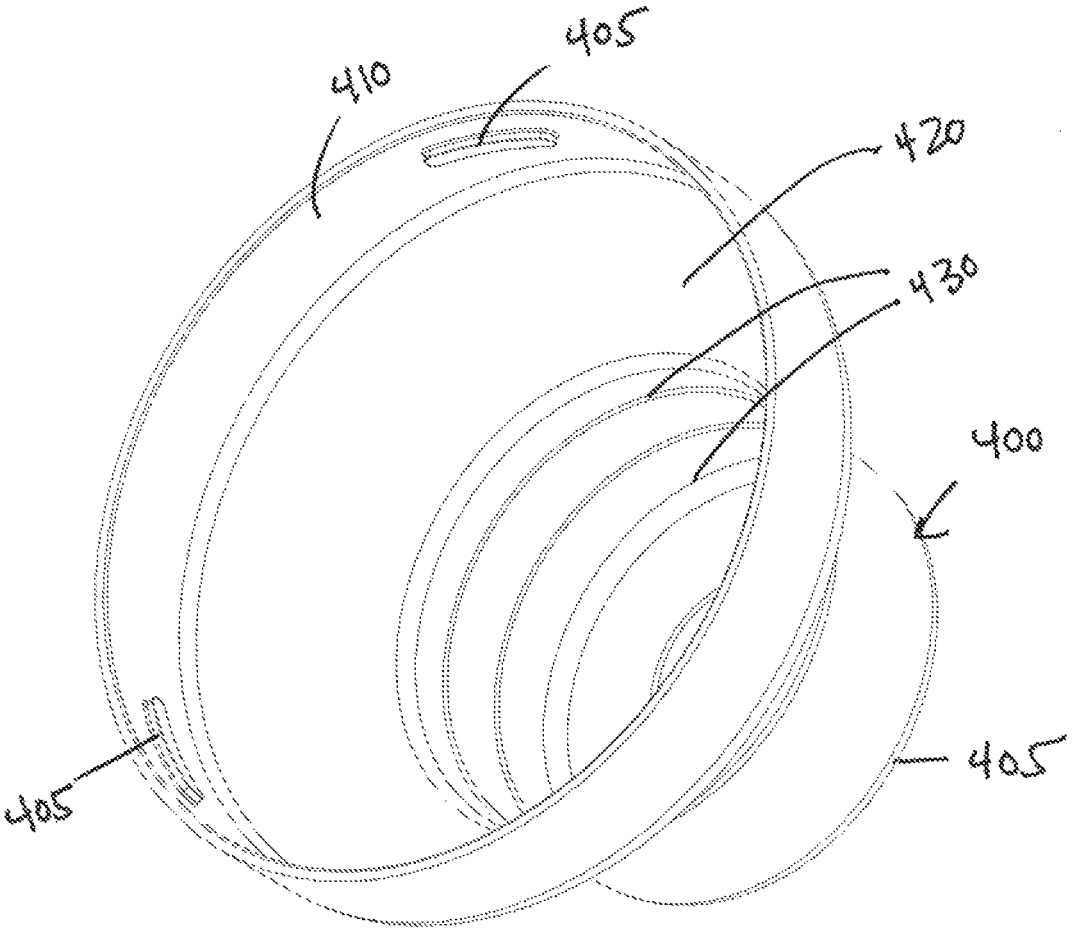
FIG. 6 is a perspective view from underneath an overcap from the dispensing container package in accordance with an embodiment of the present invention.

Illustrated in FIG. 6 is the overcap 400. The overcap 400 fits over the funnel adapter 300 and spout adapter 200. Flanges 405 positioned around the inside surface 410 of the overcap are configured and positioned to engage the spout channel ramps 235 on the outside 232 of the side wall 230 of the spout 200. The overcap 400 includes a top surface 405 that rests over the funnel opening 320 and spout opening 215, such that when secured onto the spout adapter 200 the substance in the container 110 does not leak. The top surface extends to a surrounding side wall 420 that includes at its lower end the inside surface 410. The overcap 400 may also include measuring lines 430 at different intervals along the top.

The surrounding side wall 420 of the overcap 400 may also include an indentation 450. The indentation 450 is configured to allow the funnel adapter 300 to click fit at its lower edge 335 to the overcap 400 when the overcap 400 and the funnel adapter 300 are removed from the spout adapter 200 (as illustrated in FIG. 6).

Figure 7:
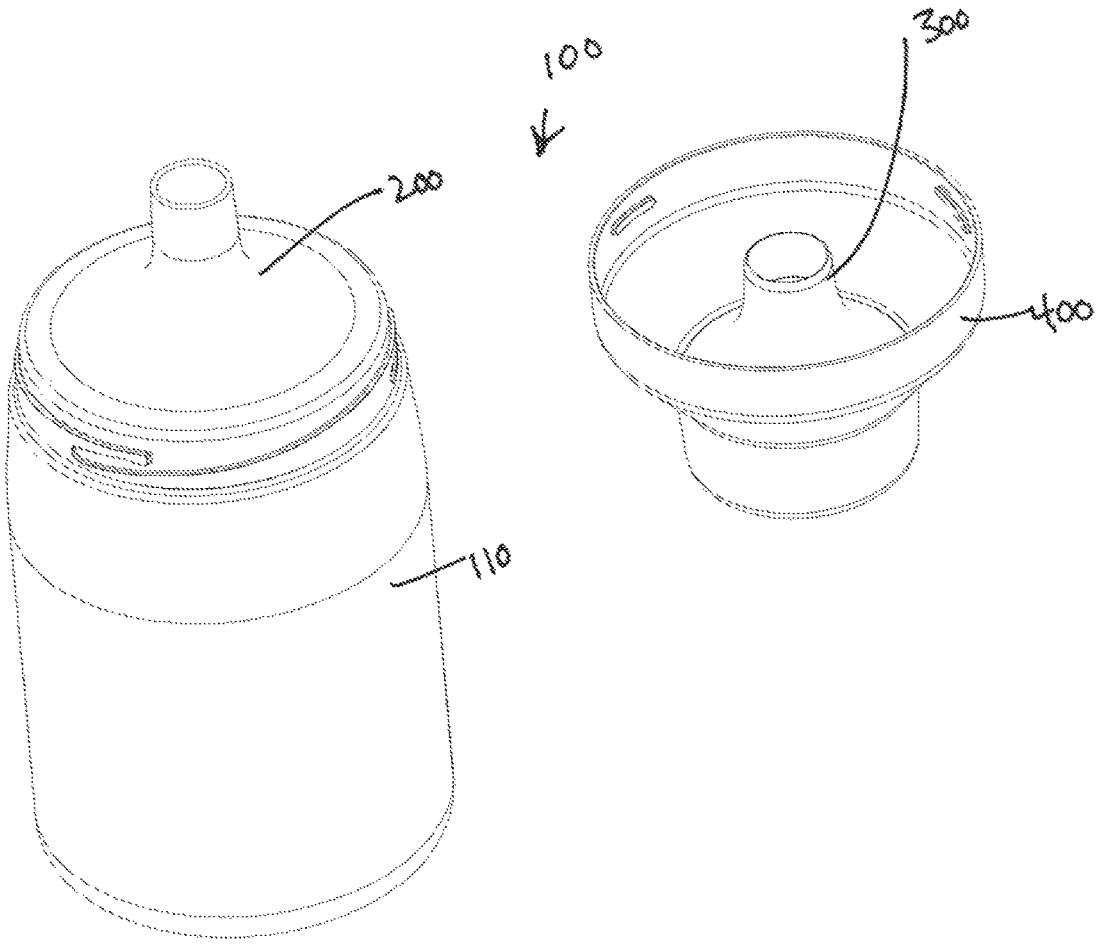
FIG. 7 is a perspective view of the dispensing container package in accordance with an embodiment of the present invention.

Continued to refer to the figures and to FIG. 7, as configured herein, the user is capable of removing the overcap 400 and the funnel adapter 300 from the container. The user may then pour substance out of the container 110 into the overcap 400 to a desired measure. If the user needs to add the substance to a bottle (such as a water bottle), the user can click fit the funnel adapter 300 to the overcap 400 over the poured substance. The user can then use the funnel end and opening to pour the substance from the overcap 400 into a bottle.

From the foregoing and as mentioned above, it is observed that numerous variations and modifications may be effected without departing from the spirit and scope of the novel concept of the invention. It is to be understood that no limitation with respect to the embodiments illustrated herein is intended or should be inferred. It is intended to cover, by the appended claims, all such modifications within the scope of the appended claims.

We claim:

1. A container package configured to hold a substance comprising:

a main container configured to hold a substance, either liquid or solid;

a spout adapter configured to secure to the main container, the spout adapter having a spout end configured for pouring a substance out of the main container;

a funnel adapter configured to frictionally fit onto the spout adapter, the funnel adapter having a funnel end configured to fit over the spout end; and an overcap configured to fit over the funnel adapter and removably secured to the spout adapter, wherein when the overcap is removed the substance can be poured into the overcap and wherein the funnel adapter is configured for removable form the spout adapter and fit into the overcap such that the substance in the overcap is pourable through the funnel adapter, and wherein the container includes an annular opening created by an annular rim that terminates to an outside edge, a container neck depending from the outside edge and the neck having an outer surface, and further includes a plurality of locking ramps and a plurality of channel ramps interspaced between adjacent locking ramps, along the outer surface of the neck, and wherein the spout adapter includes a plurality of knobs extending internally from an inside portion of a side wall defined from the spout adapter, and wherein the knobs are positioned and configured to correspond and engage the locking ramps and channel ramps on the container, such that when engaged, the knobs corresponding to the locking ramps slide and click lock with the surface detents maintaining the spout adapter in place with the container, and wherein the overcap includes a surrounding side wall that includes an indentation at a lower end on the inside portion of the overcap, the indentation configured to engage a lower edge of the funnel adapter when the funnel adapter is removed from the spout adapter and secured to the overcap.

2. The container package of claim 1, wherein:

the spout adapter is further configured to include a base having the spout end emanating therefrom, the base further having a downwardly extending side wall, and a plurality of spout channel ramps are configured around an outside portion of the side wall, each spout channel ramp includes an entrance, a stop edge, and an upper edge with a downward flange extending therefrom; and the overcap configured to fit over the funnel adapter and spout adapter, the overcap includes flanges positioned around an inside portion of the overcap, the flanges being configured and positioned to engage the spout channel ramps on the outside of the side wall of the spout.

3. The container package of claim 2, wherein the overcap includes a top surface that rests over a funnel end and spout end, such that when secured onto the spout adapter the substance in the container to prevent not leak.

4. The container package of claim 3, wherein the overcap includes a surrounding side wall that includes at its lower end the inside portion of the overcap and includes measuring lines at various intervals.

5. The container package of claim 1, wherein the plurality of locking ramps are evenly spaced around the neck at 180 degree intervals and the plurality of channel ramps are interspaced between adjacent locking ramps at even intervals.

6. The container package of claim 5, wherein each locking ramp includes an entrance opening into a channel, which ends at a surface detent.

7. The container package of claim 1, wherein the spout adapter includes fins on an inside surface, the fins configured to allow a smooth flow when pouring a substance out of the container.

8. A container package configured to hold a substance comprising:

a main container configured to hold a substance, either liquid or solid;

a spout adapter configured to secure to the main container, the spout adapter having a spout end configured for pouring a substance out of the main container;

a funnel adapter configured to frictionally fit onto the spout adapter, the funnel adapter having a funnel end configured to fit over the spout end; and an overcap configured to fit over the funnel adapter and removably secured to the spout adapter, wherein when the overcap is removed the substance can be poured into the overcap and wherein the funnel adapter is configured for removable form the spout adapter and fit into the overcap such that the substance in the overcap is pourable through the funnel adapter, and wherein the overcap includes a surrounding side wall that includes an indentation at a lower end on an inside portion of the overcap, the indentation configured to engage a lower edge of the funnel adapter when the funnel adapter is removed from the spout adapter and secured to the overcap.

9. The container package of claim 8, wherein:

the container includes an annular opening created by an annular rim that terminates to an outside edge, a container neck depending from the outside edge and the neck having an outer surface, and further includes a plurality of locking ramps and a plurality of channel ramps interspaced between adjacent locking ramps, along the outer surface of the neck; and the spout adapter includes a plurality of knobs extending internally from an inside portion of a side wall defined from the spout adapter, and wherein the knobs are positioned and configured to correspond and engage the locking ramps and channel ramps on the container, such that when engaged, the knobs corresponding to the locking ramps slide and click lock with the surface detents maintaining the spout adapter in place with the container.

10. The container package of claim 9, wherein:

the spout adapter is further configured to include a base having the spout end emanating therefrom, the base further having a downwardly extending side wall, and a plurality of spout channel ramps are configured around an outside portion of the side wall, each spout channel ramp includes an entrance, a stop edge, and an upper edge with a downward flange extending therefrom; and the overcap configured to fit over the funnel adapter and spout adapter, the overcap includes flanges positioned around the inside portion of the overcap, the flanges being configured and positioned to engage the spout channel ramps on the outside of the side wall of the spout.

11. The container package of claim 10, wherein the overcap includes a surrounding side wall that includes at its lower end the inside portion of the overcap and includes measuring lines at various intervals.

12. The container package of claim 9, wherein the plurality of locking ramps are evenly spaced around the neck at 180 degree intervals and the plurality of channel ramps are interspaced between adjacent locking ramps at even intervals.

13. The container package of claim 8, wherein the overcap includes a top surface that rests over a funnel end and spout end, such that when secured onto the spout adapter the substance in the container does not leak.

14. The container package of claim 12, wherein each locking ramp includes an entrance opening into a channel, which ends at a surface detent.

15. The container package of claim 8, wherein the spout adapter includes fins on an inside surface, the fins configured to allow a smooth flow when pouring a substance out of the container.

* * * * *